US005204171A

United States Patent [19]

Eschmann

[11] Patent Number: 5,204,171

[45] Date of Patent: Apr. 20, 1993

[54] PRESS FELT

[75] Inventor: Sylvester Eschmann, Monchen-Gladbach, Fed. Rep. of Germany

[73] Assignee: Thomas Josef Heimbach GmbH, Duren, Fed. Rep. of Germany

[21] Appl. No.: 893,883

[22] Filed: Jun. 4, 1992

Related U.S. Application Data

[63] Continuation of Ser. No. 648,166, Jan. 31, 1991, abandoned.

[30] Foreign Application Priority Data

Jan. 31, 1990 [DE] Fed. Rep. of Germany ..... 4002761

[51] Int. Cl.[5] ..... B32B 5/02

[52] U.S. Cl. ..... 428/234; 139/383 A; 162/900; 428/280; 428/282; 428/293; 428/294; 428/300; 428/297; 428/298

[58] Field of Search ..... 428/280, 282, 293, 294, 428/297, 298, 300, 234; 162/DIG. 1, 358; 139/383 A

[56] References Cited

U.S. PATENT DOCUMENTS

| | | | |
|---|---|---|---|
| 1,651,476 | 12/1927 | Sheehan | 428/280 |
| 4,107,367 | 8/1978 | Fekete | 428/282 |
| 4,283,454 | 8/1981 | Buchanan | 428/233 |
| 4,382,987 | 5/1983 | Smart | 428/282 |
| 4,482,601 | 11/1984 | Hartigan, Jr. | 428/234 |
| 4,500,588 | 2/1985 | Lundström | 428/280 |
| 4,529,643 | 7/1985 | Lundström | 428/280 |
| 4,564,985 | 1/1986 | Tanabe | 428/234 |
| 4,657,806 | 4/1987 | Dutt | 428/234 |
| 4,772,504 | 9/1988 | Andresen | 428/96 |
| 4,781,967 | 11/1988 | Legge et al. | 428/300 |

*Primary Examiner*—James J. Bell
*Attorney, Agent, or Firm*—Joseph W. Berenato, III

[57] ABSTRACT

The invention concerns a press felt for the pressing region of a papermaking machine and comprises a belt of support material made of one or more fabrics or knits and one layer of fibers deposited at least on the paper side and connected to the belt of support material, the surface of this layer of fibers forming the paper contact-side and a permeable layer being mounted in said layer of fibers between the paper contact-side and the belt of support material. To improve dehydration, the permeable layer is designed to be a blocking layer 7 with a surface covering of 45 to 85%, the blocking layer 7 comprising transverse, elongated passages 9.

13 Claims, 1 Drawing Sheet

PRESS FELT

This is a continuation of co-pending application Ser. No. 07/648,166, filed on Jan. 31, 1991 is now abandoned.

The invention concerns a press felt for the pressing region of a papermaking machine with a belt of support material consisting of one or more fabrics or knits and comprising a layer of fibers deposited at least on the paper side and connected to the belt of support material, the surface of this layer of fibers forming the side in contact with the paper.

Press felts are known from many publications, illustratively from U.S. Pat. Nos. 4,283,454 and 4,564,985. Both documents disclose a press felt which on the side away from making contact with the paper comprises a belt of support material consisting of two superposed fabrics. These two fabrics are connected together by a stitched layer of fibers, these fibers being deeply stitched into the two fabrics The upper side of the layer of fibers forms the paper contact-side.

Moreover press felts are known of which the belts of support material consist of crosswise superposed filaments (European patent document A 0,038,276), where called for a layer of fibers also being provided between the individual crosswise superposed filaments (U.S. Pat. No. 4,781,967). The particular uppermost filament netting extends longitudinally. Contrary to the case of the fabric or knit support materials, the individual filament layers are not connected to each other.

The U.S. Pat. No. 1,651,476 discloses a press felt wherein a layer of fibers is bonded onto a belt of support material in the form of a fabric, the bonding being implemented by a coating of adhesive deposited on the belt of support material The bonding coating is porous and accordingly is permeable to the liquid pressed out of the paper web.

The problem of remoistening the paper web after it leaves the pressing gap arises with press felts. The previously compressed press felt then increases in cross-section The water moves along the higher capillarity and spreads over the entire cross-section of the press felt as far as the paper contact-side In this manner part of the water already removed from the paper web returns to it.

To avoid such problems, the U.S. Pat. No. 4,772,504 proposes a press felt of which the paper contact-side is formed by a surface layer deposited on the felt layer. This surface layer consists of a plastic, for instance a foam, of which the pores are nearly entirely filled by a sealing material Accordingly the stated maximum values of surface-layer permeability are minute and approach zero. The purpose of the surface layer is to more impede the water in the felt toward the paper contact-side than to the other side and thereby to prevent remoistening the paper web.

It has been overlooked in this press felt design that its main purpose is to move the squeezed liquid through it and that it must be accordingly permeable. If there is virtually complete sealing of the paper contact-side, a corresponding drop in dehydration performance must be expected—which cannot be compensated by the claimed reduction in remoistening. On the whole the dehydration performance is not improved by such a press felt over conventional ones, whereas its manufacturing cost however is higher.

The object of the invention is to so further develop a press felt of the initially cited kind that its dehydration shall be improved, in particular by reducing the paper web's remoistening.

This problem is solved by the invention in that the permeable layer is designed to be a blocking layer covering 45 to 85% of the surface and shall comprise transverse, elongated passages In the invention, the species-forming press felt is designed as a blocking layer reducing the flow cross-section to about 15 to 55% of the press-felt area. As a result, the water flowing through the press felt will be accelerated in the vicinity of the blocking layer by the nozzle-effect of the passages. Consequently a pressure drop propagating as far as the paper web arises in the region between the paper contact-side and the blocking layer and uniformly sucks the water out of the paper web. In especially important manner, the passages are longitudinally elongated and transverse. In this way they act like foils used in the forming zone of papermaking machines and support the above mentioned suction effect. In spite of the surface cover entailed by the blocking layer, dehydration is improved.

After it leaves the pressing gap, the blocking layer practically acts like a check valve. The felt will expand again, however on account of the blocking layer it can only attract little air or moisture from the zone underneath the blocking layer. The press felt therefore does not expand as fast, and as a result, it will not prematurely detach from the paper web. Thereby the remoistening is reduced to a minimum. On the whole therefore the press felt of the invention offers substantially better dehydration.

The blocking layer can be deposited directly on the belt of support material. Once the layer of fibers has been stitched into the belt of support material, it still shall be inside the layer of fibers. However it is possible also to mount the blocking layer a distance from the belt of support material, the distance between the blocking layer and the paper contact-side appropriately at most being as large as the distance to the belt of support material, so that preferably the blocking layer shall be located in the vicinity of the paper contact-side but not at its surface.

Preferably the passages are transverse elongated slots and are as continuous as possible The slots are formed by mutually spaced cross filaments representing the blocking layer. Especially advantageously the cross filaments shall be flat, for instance as disclosed in the European patent 0,098,612. The above cited foil effect then shall be especially pronounced.

The press felt can be manufactured in such a way that first a fabric is formed by said cross filaments and by means of dissolving, especially water-soluble longitudinal filaments and in that after the making of the press felt, the longitudinal filaments shall be dissolved using a solvent Thereupon the cross filaments forming the blocking layer shall remain.

The drawing elucidates the invention by means of an illustrative embodiment.

Figure 1:
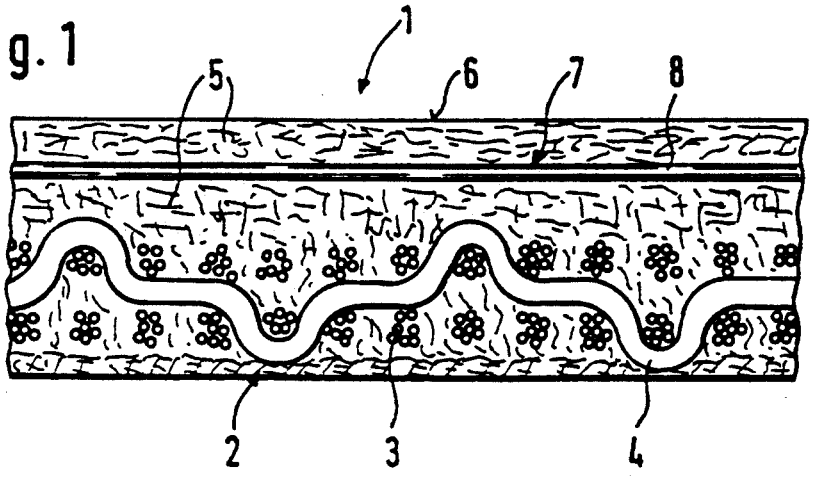
FIG. 1 is a cross-section of a press felt.

The press felt 1 shown in the Figures comprises a support fabric 2 in its lower region which consists of two layers of longitudinal filaments illustratively denoted by 3 and of cross filaments illustratively denoted by 4 which lace together the longitudinal filaments of both layers. The longitudinal filaments 3 and the transverse filaments 4 are monofilaments. Suitable materials are plastics, for instance polyamides or polyesters.

A layer of fibers 5 is present at the top side of the support fabric 2. The free side of this layer forms the paper contact-side 6. A blocking layer 7 consisting of a plurality of flat filaments illustratively denoted by 8 which are transverse to the direction of advance of the press felt I is inserted into the upper half of the layer of fibers 5. The blocking layer 7 is parallel to the paper contact-side 6. The flat filaments 8 also consist of plastic and their cross-section is approximately rectangular, their extension in the plane of the blocking layer 7 being significantly larger than perpendicularly to it. The flat filaments 8 are spaced in such manner that slots illustratively denoted by 9 are created between them. The total cross-section of these slots 9 shall be between 15 and 55% of the total surface of the press felt 1 in the design of this invention.

Figure 2:
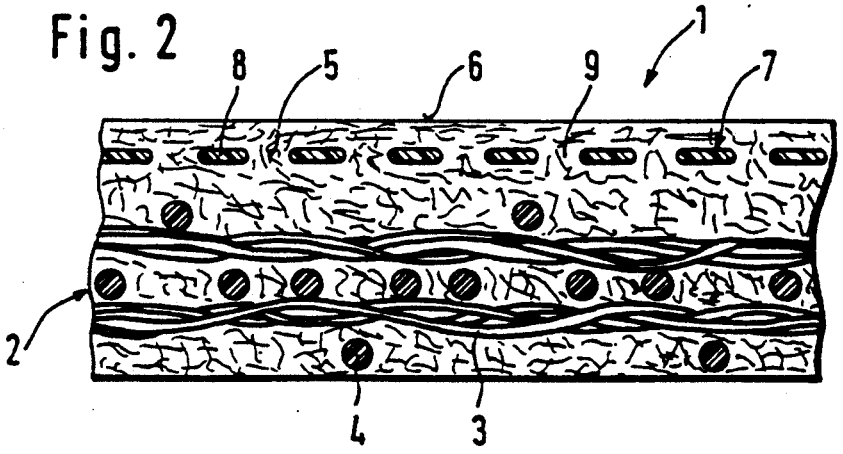
FIG. 2 is a longitudinal section of the press felt of FIG. 1.

The press felt 1 of the invention can be manufactured as follows: First the support fabric 2 is woven. Then a first layer of non-woven fibers is deposited on the support fabric 2 and stitched to it. At the same time the blocking layer 7 initially in the form of a fabric is prepared by interlacing flat filaments 8 with water-soluble longitudinal threads illustratively consisting of polyvinyl alcohol. This fabric blocking layer 7 is deposited on the first part of the layer of fibers 5. Then a further layer of non-woven material is deposited on the blocking layer 7 and is stitched to the remaining part of the press felt 1. Lastly the press felt 1 is subjected to water treatment ensuring the dissolution of the longitudinal filaments of the blocking layers 7. Only the flat filaments 8 remain. Now the press felt 1 assumes the design shown in FIGS. 1 and 2.

In the vicinity of the press gap the flat filaments 8 assure the deflection of water at the flat filaments 8 and its being accelerated near the slots 9. The effect that ensues is similar to that from foils in the forming region of papermaking machines. The water moves faster than the press felt 1, so that in practice suction is generated in the vicinity of the paper contact-side 6.

A vacuum is generated above the blocking layer 7 when passing the pressing gap because the previously compressed press felt 1 will expand again, but hardly any air or moisture can follow from below. Above the blocking layer 7, the press felt 1 therefore no longer fills with water. .Because the press felt 1 expands only after a delay, it detaches earlier from the paper web 1 whereby the residual moisture absent above the blocking layer 7 no longer can be introduced into the paper web.

I claim:

1. A press felt for a papermaking machine, comprising:

a. a lower fabric layer comprised of a plurality of interlaced longitudinal and cross filaments; and b. an upper fabric overlaid on said lower fabric layer and having an upper paper contacting surface, said upper fabric includes a blocking layer intermediate said lower fabric layer and said paper contacting surface and said blocking layer comprising a plurality of mutually spaced filaments extending transverse to the direction of advance of the felt and a substantially continuous passage is disposed between adjacent filaments of said blocking layer for permitting water to flow therethrough to said lower fabric layer while preventing water from flowing therethrough to said upper fabric and said blocking layer disposed parallel to said paper contacting surface.

2. The felt of claim 1, wherein:

a. said blocking layer covers from about 45% to about 85% of said upper fabric layer.

3. The felt of claim 1, wherein:

a. said blocking layer filaments are rectangular in cross section.

4. The felt of claim 3, wherein:

a. said blocking layer filaments are flat, and each filament extends parallel to said paper contacting surface.

5. The felt of claim 4, wherein:

a. each of said passages is an elongated slot.

6. The felt of claim 1, wherein:

a. said blocking layer is spaced from said paper contacting surface a distance not exceeding the distance said blocking layer is spaced from said lower fabric layer.

7. The felt of claim 1, wherein:

a. said longitudinal and cross filaments are plastic monofilaments;

b. said blocking layer filaments are plastic.

8. A paper machine press felt assembly, comprising:

a. a lower fabric layer comprised of a plurality of interlaced longitudinal and cross filaments; and b. an upper fabric layer overlaid on and stitched to said lower fabric layer and having an upper paper contacting surface, said upper fabric layer includes a blocking layer disposed parallel to said paper contacting surface and comprising a plurality of mutually spaced plastic filaments extending transverse to the direction of felt advance and a plurality of soluble threads extending parallel to the direction of felt advance so that, after said soluble threads have been dissolved, a substantially continuous passage is disposed between adjacent ones of said plastic filaments for permitting water to flow therethrough to said lower fabric layer while preventing water from flowing therethrough to said upper fabric layer.

9. The assembly of claim 8, wherein:

a. said plastic filaments are rectangular in cross section.

10. The assembly of claim 9, wherein:

a. said plastic filaments are flat and each plastic filament extends parallel to said paper contacting surface.

11. The assembly of claim 9, wherein:

a. said plastic filaments overlie from about 45% to about 85% of said lower fabric layer.

12. The assembly of claim 8, wherein:

a. said blocking layer is intermediate said paper contacting surface and said lower fabric layer.

13. The assembly of claim 12, wherein:

a. said blocking layer is spaced from said paper contacting surface a distance not exceeding the distance said blocking layer is spaced from said lower fabric layer.

* * * * *